US005774688A

United States Patent [19]

Georgitsis et al.

[11] Patent Number: 5,774,688

[45] Date of Patent: Jun. 30, 1998

[54] FORMAT ADJUSTMENT APPARATUS AND METHOD FOR BOOKBINDING

[75] Inventors: Nikolaos Georgitsis, Rahden; Uwe Trox, Stemwede, both of Germany

[73] Assignee: Kolbus GmbH & Co. KG, Rahden, Germany

[21] Appl. No.: 375,697

[22] Filed: Jan. 20, 1995

[30] Foreign Application Priority Data

Jan. 21, 1994 [DE] Germany ..... 44 01 668.9
May 18, 1994 [DE] Germany ..... 44 17 296.6

[51] Int. Cl.[6] ..... G06G 7/66; B42C 13/00

[52] U.S. Cl. ..... 395/500; 364/468.01; 364/468.02; 364/468.24; 364/414.1; 412/11; 412/12; 412/13; 412/14

[58] Field of Search ..... 395/500, 109, 395/143, 147, 148; 364/578, 468, 410 R, 419.01, 419.19, 478, 550, 551.01, 55.02, 474.01, 474.02, 474.1, 474.11, 474.22, 474.26, 474.34, 474.36, 468.01, 468.02, 471.01, 474.03, 468.21, 468.28, 468.24; 434/317, 308, 178, 335, 322, 401; 345/173, 185, 901; 412/1–19, 20, 21, 25, 28, 30, 33; 29/407.01, 407.09, 407.1, 709, 714

[56] References Cited

U.S. PATENT DOCUMENTS

| | | | |
|---|---|---|---|
| 3,731,330 | 5/1973 | French | 412/19 |
| 4,425,098 | 1/1984 | Döring | 434/317 |
| 4,537,342 | 8/1985 | McCain et al. | 227/78 |
| 4,855,725 | 8/1989 | Fernandez | 345/173 |
| 5,086,497 | 2/1992 | Horikawa et al. | 395/147 |
| 5,338,125 | 8/1994 | Forsse et al. | 402/46 |
| 5,371,680 | 12/1994 | Anno et al. | 364/478 |
| 5,398,289 | 3/1995 | Rourke et al. | 382/100 |
| 5,417,575 | 5/1995 | McTaggart | 434/317 |
| 5,465,213 | 11/1995 | Ross | 364/468 |
| 5,517,407 | 5/1996 | Weiner | 364/419.01 |

FOREIGN PATENT DOCUMENTS

| | | |
|---|---|---|
| 2 662 891-A1 | 12/1991 | France . |
| 3713359 A1 | 11/1987 | Germany . |
| 3905320 A1 | 8/1990 | Germany . |
| 4020375 A1 | 1/1992 | Germany . |

OTHER PUBLICATIONS

"DD–Marktübersicht: Buchfadenheftmaschinen," by Reinmar Dammköhler, Mar. 12, 1992.

"Computer funkt selbst," by Von Hans–Walter Knuppertz, Apr. 1988.

"Rundsteuern mit den Fernsteuer–bausteinen SLB 3801 und 3802," by Dipl.–Ing. Michael Beitner, Oct. 1983.

*Primary Examiner*—Jacques Louis-Jacques
*Attorney, Agent, or Firm*—Alix, Yale & Ristas, LLP

[57] ABSTRACT

The set-up procedure for a bookbinding machine is accomplished through the use of a portable computer with an integral data transceiver. Adjustable machine element position information is entered into the portable computer and transmitted to the machine control via a wireless data link and an operator/machine interface. Actual machine element position is sensed and transmitted to the portable computer where it is displayed. Using the portable computer and data link, the operator may serially proceed from one functional machine station to the next to perform the set-up.

14 Claims, 2 Drawing Sheets

FORMAT ADJUSTMENT APPARATUS AND METHOD FOR BOOKBINDING

BACKGROUND OF THE INVENTION

1. Field of the Invention

The present invention relates to the manufacture of books and particularly to facilitating the set-up of machines used in a bookbinding process. More specifically, the present invention relates to control systems for facilitating the adjustment of bookbinding apparatus to accommodate changes in book format. Accordingly, the general objects of the present invention are to provide novel and improved methods and apparatus of such character.

2. Description of the Prior Art

The manufacture of books has long been recognized as a relatively labor intensive endeavor requiring the services of skilled artisans. Because of the costly set-up procedures required each time a different book format is dictated, labor costs often influence production decisions such as, for example, whether to print short runs or limited editions. With a view to shortening the set-up times, of machines employed in a bookbinding procedure and to generally simplify the operation of such machines, computer-controlled machines have been introduced. In the employment of such computer-controlled machines, the final control element adjustments required for a format change are effected through the agency of servo motors and adjusting spindles. The adjustment commands are produced at a man/machine interface that serves as an input/output control for the machine operator. Thus, in the case of computer-controlled machines employed in bookbinding, the values of the parameters which are to be manipulated, such parameters defining the book format, are either input manually, via a keyboard associated with the interface, or entered by means of a measuring device. In either case, position information as well as command signals for the servo motors will be computed and operational status information will be displayed on a screen. Communication between the servo motors and the interface will typically be via a machine control with the various components being "hard wired" together to define a control system. Activation of the servo motors will result in the adjustable elements of the machine being moved to positions corresponding to the manipulated-variable values input via the interface.

The field of bookbinding imposes unique requirements on one seeking to impart a degree of automation to the set-up of the machines which are to be employed. Firstly, the manufacture of a book requires the use of a number of separate machines, each machine typically having a plurality of adjustment elements all of which must be adjusted in accordance with the desired book format. Secondly, the individual machines involved are typically large and occupy considerable floor space. Thirdly, operating conditions, including the fact that the product being worked is comprised of paper, dictate the necessity of observing many of the individual machine element adjustment processes. The net result of these requirements is that the operational status information for an adjustable machine element must be made available in the form of a display both in the vicinity of the adjustable element and at the operator/machine interface.

It has been proposed, in the prior art, to provide display devices and means for inputting data in the form of position commands at the individual locations on the machine where the adjustments are to be made. Such "local" displays and input devices would enable desired adjustable element position information to be entered directly at the point where the control action is to occur thus enabling the operator to monitor the set-up related readjustment. In the case of such "local" input of position information, the data entered by the operator would also have to be stored in a computer associated with the interface. The provision of separate display and data input devices at each of the individual adjustable elements of a bookbinding machine would add considerable complexity and expense to the machine control system.

SUMMARY OF THE INVENTION

The present invention overcomes the above-briefly discussed and other deficiencies and disadvantages of the prior art by providing a novel arrangement and technique which simplifies the set-up of a book binding machine and, in so doing, precipitates the advantages of reduced complexity and expense of a control system for such a machine.

In accordance with the present invention, the entry of desired operational status information and the display of such information may be executed through the use of a common, portable hand-held terminal which communicates with the operator/machine interface. Such a hand-held terminal is provided with a mechanism by which data may be entered, a keyboard for example, and each of the adjustable machine elements to be controlled is identified at this data entry mechanism by means of an assigned defining symbol. Also, by means of the hand-held terminal, the operator may retrieve the actual manipulated-variable values, i.e., the operational parameters or position information. For this purpose, the hand-held terminal includes a display which, for example, may comprise an LCD screen for displaying the defining symbols, manipulated-variable values and the machine functions which are to be controlled. Both the hand-held terminal and the interface are equipped with a full-duplex transmitter-receiver whereby wireless communication may be established between the hand-held terminal and the computer of the interface. In the practice of the invention, the wireless data link will preferably employ infrared energy as the transmission medium and, if necessary, communication between the hand-held terminal and the interface may be via judiciously located repeater units.

BRIEF DESCRIPTION OF THE DRAWING

The present invention may be better understood, and its numerous objects and advantages will become apparent to those skilled in the art, by reference to the accompanying drawings wherein like reference numerals refer to like elements in the two figures and in which.

DESCRIPTION OF THE DISCLOSED EMBODIMENTS

Figure 1:
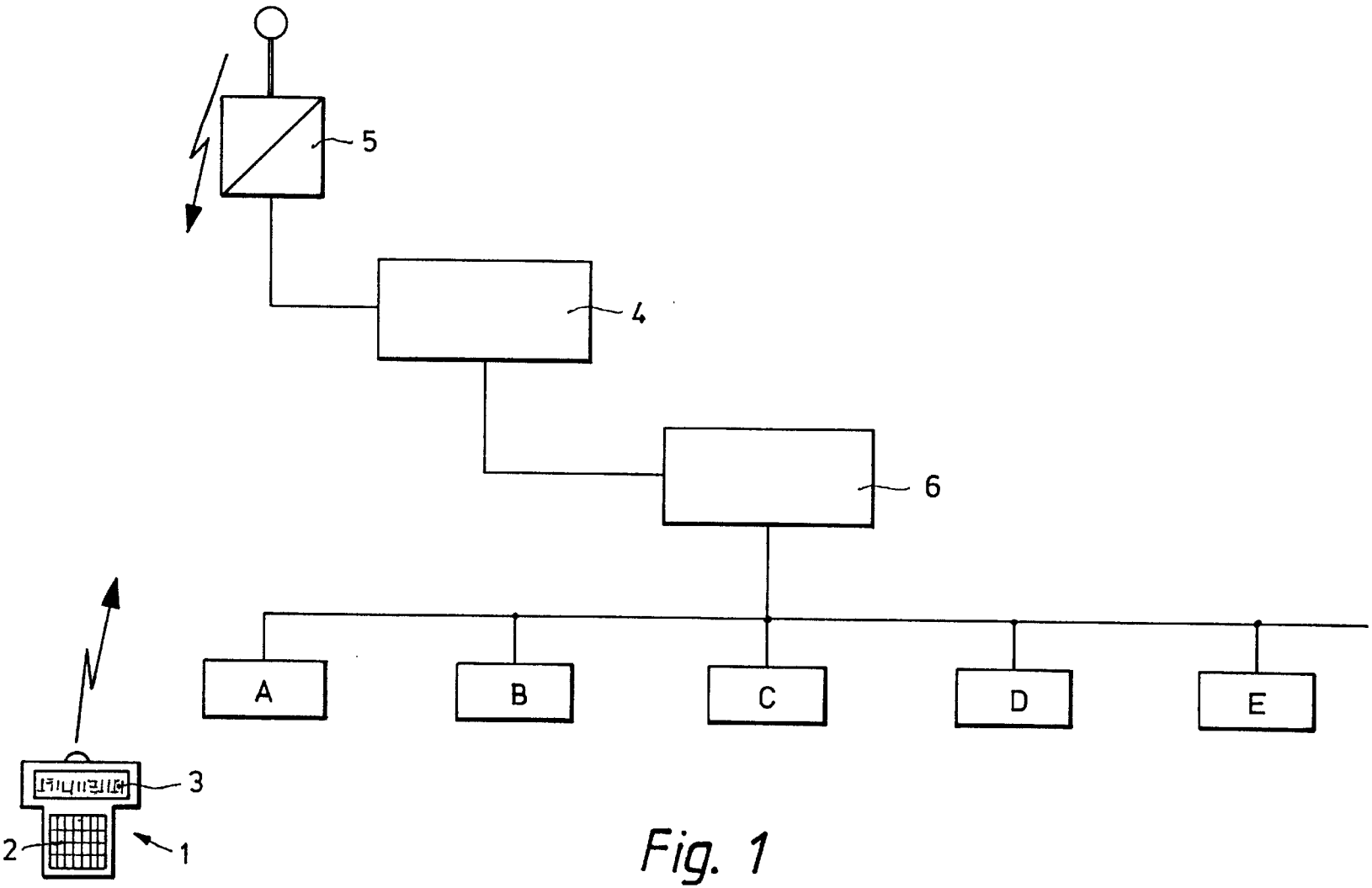
FIG. 1 is a functional block diagram of a control arrangement for a single machine employed in a bookbinding operation in accordance with the present invention.

With reference to FIG. 1, visually observable adjusting mechanisms, located at a plurality of functional stations of a machine which defines a portion of a book production line are indicated by A–E. Through the exercise of control over the adjusting mechanisms, a bookbinding machine operator may set-up the machine to accommodate books having different formats. The adjusting mechanisms A–E will typically each comprise a repositionable machine element, the actuator therefor and a position sensor which provides a signal commensurate with actual position. The actuators for the adjusting mechanisms may be responsive to electrical, hydraulic or pneumatic command signals and, typically, will be servo motors. The actuators and position sensors are connected to a machine control apparatus 6 which may, for example, be an SPS control apparatus. Communication between the adjusting mechanisms A–E and control apparatus 6 may be either direct or via a common data bus as indicated in FIG. 1, i.e., the actuators and associated sensors may include the appropriate signal convertors to enable digital data transfer between control apparatus 6 and the adjusting mechanisms.

The machine control apparatus 6 is coupled to the operator/machine interface 4 which, typically, will be a personal computer. The PC of interface 4 serves as the primary input/output means for the machine operator. Thus, all machine control commands may be entered at interface 4 via a keyboard and all actions executed by the machine, in response to the commands, are also displayed at interface 4.

In accordance with the present invention, a data input mechanism and a display at each adjusting mechanism location is simulated by means of a single, i.e., common, portable, hand-held terminal 1. Terminal 1, as depicted in FIG. 1, includes a keyboard 2 and an LCD display panel 3.

The portable hand-held terminal 1 is provided with an integral full duplex transceiver. This transceiver is employed to establish a wireless data transmission link between terminal and interface 4 via a remote transceiver unit 5. The full duplex transceiver 5 is connected via a cable to the PC of interface 4 and is capable of continuously exchanging data between hand-held terminal 1 and interface 4. Data transmission will preferably be via infrared energy but may alternatively be via electromagnetic energy in the radio frequency range. While not necessary for the practice of the present invention, the hand-held terminal 1 may be capable of a temporary, direct connection to some or all of the adjusting mechanisms via electrical connections of the plug-and-socket type.

In the practice of the present invention, the bookbinding machine operator will proceed to the appropriate functional station of the machine to be reconfigured commensurate with a book format change where, employing the assigned symbol on the keyboard 2 of the hand-held terminal 1, this station will be "called up", i.e., the station identification will be transmitted to interface 4 via the wireless communication link. The interface will respond by causing the transmission, to terminal 1, of the existing operational status of the adjustable machine element at the station. Accordingly, the hand-held terminal 1 becomes an operating and display instrument for the identified functional station of the machine and, using terminal 1, the operator will be placed in communication with the machine control apparatus 6 via transceiver 5 and interface 4. Once the existing operating parameters of the adjusting mechanism are displayed, the operator can enter data via keyboard 2 which will result in repositioning of the machine element of the adjusting mechanism and can observe the response of the adjusting mechanism to the inputted information. Having achieved the desired set-up at a first functional station, the operator may then proceed from station to station until the set-up procedure for the individual machine is completed.

Figure 2:
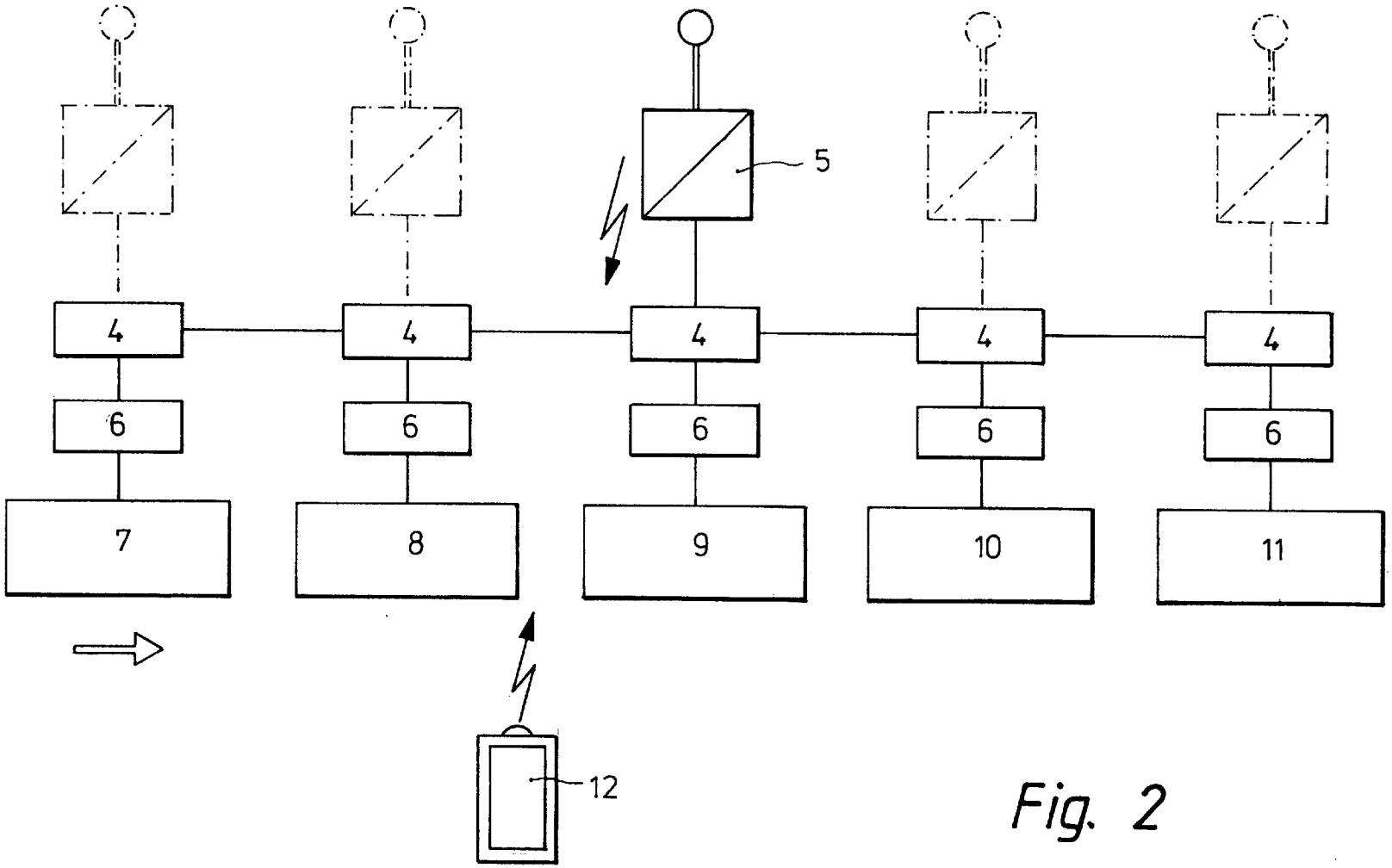
FIG. 2 is a view, similar to FIG. 1, which schematically illustrates the application of the present invention to multiple machines which are employed in the manufacture of a book.

FIG. 2 schematically illustrates the use of the present invention in the environment of a book production line. A book production line may, for example, comprise a collating machine 7, an adhesive-binding machine 8, a trimming machine 9, a book finishing line with a binding-in machine 10 and a palletizing machine 11. Each individual machine may be computer controlled, i.e., have a man/machine interface 4, and will have a machine control 6 such as the control discussed above. A common hand-held computer with a touch-screen 12 may be employed for directing the entire control process as well as for the set-up adjustments of each individual machine. This hand-held computer communicates with all of the interfaces 4 via a transceiver 5. Alternatively, as indicated by the broken line showing of FIG. 2, each machine of the production line may be provided with its own transceiver unit 5. The hand-held computer may, in addition to the integral transceiver, be equipped with a laser-scanner which will have the capability of recognizing indicia imprinted on each machine and/or at each functional station of each machine. This scanner capability frees the machine operator from entering information to call up the station where a machine element to be adjusted is located.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. Apparatus for facilitating the set-up of a machine for use in a bookbinding process, the machine having a plurality of adjustable elements which are positioned as a function of parameters of the book to be manufactured, said adjustable elements including actuators responsive to command signals and sensors for providing signals commensurate with the actual position of the associated adjustable element, the machine further having a control for generating position command signals for the actuators, said apparatus comprising:

means for establishing an interface between the machine control and a machine operator, said interface establishing means including computer means having data entry capability, actuator command signals being generated in response to data entered into said computer means;

portable terminal means, said portable terminal means including a display and means for entering book parameter related data, said display having indicia unique to the machine elements to be adjusted; and data link means for exchanging data between said portable terminal means and said computer means whereby repositioning of the machine elements can be accomplished by entering data into said portable terminal means and transmitting said data to said computer means via said data link means, and the actual position of a machine element can be displayed at said portable terminal means.

2. The apparatus of claim 1 wherein said data link employs wireless data transmission.

3. The apparatus of claim 1 wherein said portable terminal means comprises a hand-held computer.

4. The apparatus of claim 2 wherein said portable terminal means comprises a hand-held computer.

5. The apparatus of claim 3 wherein said hand-held computer data entry means is a touch-screen.

6. The apparatus of claim 4 wherein said hand-held computer data entry means is a touch-screen.

7. The apparatus of claim 3 where said hand-held computer includes an optical scanner whereby said hand-held computer can recognize printed indicia commensurate with an adjustable machine element and, in response to such recognition, generate a call-up request for transmission to said computer means via said data link means.

8. The apparatus of claim 4 where said hand-held computer includes an optical scanner whereby said hand-held computer can recognize printed indicia commensurate with an adjustable machine element and, in response to such recognition, generate a call-up request for transmission to said computer means via said data link means.

9. The apparatus of claim 1 further comprising:

means for temporarily establishing an electrically conductive information flow path between said portable terminal means and an adjacent machine element.

10. The apparatus of claim 1 wherein the machine to be set-up operates in conjunction with other machines having adjustable elements and wherein said portable terminal means may be used to cause repositioning of the adjustable elements of said other machines via an interface establishing means uniquely associated with each of such other machines.

11. Apparatus for facilitating the set-up of a machine for use in a bookbinding process, the machine having a plurality of adjustable elements which are positioned as a function of the parameters of the book to be manufactured, said adjustable elements including actuators responsive to command signals and sensors for providing signals commensurate with the actual position of the associated adjustable elements, the machine further having a control for generating position command signals for the actuators, said apparatus comprising:

means for establishing an interface between the machine control and a machine operator, said interface establishing means including computer means, said computer means being coupled to the machine control and the machine control generating the position command signals in response to information provided by said computer means;

portable terminal means, said portable terminal means including a display and means for entering book parameter related data, said terminal means locally displaying position information for a selected adjustable element, said portable terminal means also including transceiver means for sending and receiving data; and wireless data link means for establishing data communication between said portable terminal means and said computer means whereby repositioning of the machine elements can be serially accomplished by entering data into said portable terminal means and establishing data communication between said portable terminal means and the machine control via said data link means and interface means, and wherein the actual position of a machine element to said terminal means can be displayed at said portable terminal means by transmitting position information from the adjustable element via the machine control and interface establishing means.

12. The apparatus of claim 11 wherein said portable terminal means comprises a hand-held computer.

13. The apparatus of claim 10 wherein said means for entering book parameter related data of said portable terminal means includes input devices uniquely associated with individual machine elements.

14. In a process for the set-up of a machine used in a bookbinding process, the machine having a plurality of adjustable elements which are positioned as a function of parameters of the book to be manufactured, said adjustable elements including actuators responsive to command signals and sensors for providing signals commensurate with the actual position of the associated adjustable element, the machine further having a control for generating position command signals for the actuators, the improvement comprising the steps of:

(a) transmitting, from the vicinity of a first machine element to be adjusted, an electromagnetic signal including a unique code associated with the said first machine element;

(b) receiving, at a machine interface, the transmitted code and the actual position information provided by the adjustable element associated sensor;

(c) transmitting, to the vicinity of the said first machine element to be adjusted, and thereafter receiving and locally displaying said actual position information;

(d) generating at the vicinity of said first machine element, a reposition request signal;

(e) transmitting the reposition request signal to the interface to thereby cause repositioning information to be computed and a position command change signal to be generated and delivered to the machine element via the machine control;

(f) monitoring said local display to ensure that the requested repositioning action has occurred; and (g) repeating steps (a)–(f) for a second machine element employing the same data transmission and reception hardware and the same reposition request signal generator.

* * * * *